US007097758B2

(12) United States Patent
Stell et al.

(10) Patent No.: US 7,097,758 B2
(45) Date of Patent: Aug. 29, 2006

(54) CONVERTING MIST FLOW TO ANNULAR FLOW IN THERMAL CRACKING APPLICATION

(75) Inventors: Richard C. Stell, Houston, TX (US); Jennifer L. Bancroft, Houston, TX (US); Arthur R. Dinicolantonio, Seabrook, TX (US); George Stephens, Humble, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 578 days.

(21) Appl. No.: 10/189,618

(22) Filed: Jul. 3, 2002

(65) Prior Publication Data

US 2004/0004028 A1 Jan. 8, 2004

(51) Int. Cl.
*C10G 9/16* (2006.01)

(52) U.S. Cl. ..... 208/48 R; 208/125; 208/128; 208/130; 208/132; 585/652

(58) Field of Classification Search ..... 208/48 R, 208/125, 128, 130, 132; 585/652
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | |
| 3,341,429 | A | 9/1967 | Fondrk | |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | |
| 3,505,210 | A | 4/1970 | Wallace et al. | |
| 3,617,493 | A | 11/1971 | Wirth et al. | 208/80 |
| 3,677,234 | A | 7/1972 | Dutkiewicz | |
| 3,718,709 | A | 2/1973 | Simonetta | 260/683 R |
| 3,900,300 | A | 8/1975 | Lehman | |
| 4,199,409 | A | 4/1980 | Skraba | |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | |
| 4,400,182 | A | 8/1983 | Davies et al. | |
| 4,426,278 | A | 1/1984 | Kosters | 208/130 |

(Continued)

FOREIGN PATENT DOCUMENTS

DE 10 93 351 11/1960

(Continued)

OTHER PUBLICATIONS

"Specialty Furnace Design: Steam Reformers and Steam Crackers", presented by T.A. Wells of the M.W. Kellogg Company, 1988 AIChE Spring National Meeting.

(Continued)

*Primary Examiner*—Tam M. Nguyen
(74) *Attorney, Agent, or Firm*—Kelly A. Nowak; Linda A. Kubena

(57) ABSTRACT

A process to increase the non-volatile removal efficiency in a flash drum in the steam cracking system. The gas flow from the convection section is converted from mist flow to annular flow before entering the flash drum to increase the removal efficiency. The conversion of gas flow from mist flow to annular flow is accomplished by subjecting the gas flow first to at least one expander and then to bends of various degrees and force the flow to change directions at least once. The change of gas flow from mist to annular helps coalesce fine liquid droplets and thus being removed from the vapor phase.

25 Claims, 3 Drawing Sheets

U.S. PATENT DOCUMENTS

| | | | | |
|---|---|---|---|---|
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian | |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,351 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B1 | 6/2004 | Powers | |
| 2001/0016673 | A1 | 8/2001 | Bridges et al. | |
| 2003/0070963 | A1 | 4/2003 | Zimmermann et al. | |
| 2004/0039240 | A1 | 2/2004 | Powers | |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 10/1977 |
| GB | 2 012 176 | 11/1977 |
| JP | 3111491 | 5/1991 |
| NL | 7410163 | 4/1975 |
| SU | 1491552 | 7/1989 |
| WO | WO 01/55280 | 8/2001 |
| WO | WO 2004/005431 | 1/2004 |
| WO | WO 2004/005432 | 1/2004 |
| WO | WO 2004/005433 | 1/2004 |
| ZA | 907394 | 9/1990 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Lummus Crest Inc., JP03111491 (Abstract), May 13, 1991.

Mitsui Sekka Engineering Co., Ltd./Mitsui Engineering & Shipbuilding Co., Ltd., "Mitsui Advanced Cracker & Mitsui Innovative Quencher", pp. 1-16.

TYPICAL EXPANDERS

CONVERTING MIST FLOW TO ANNULAR FLOW IN THERMAL CRACKING APPLICATION

BACKGROUND OF THE INVENTION

1. Field of the Invention

The present invention relates to converting mist flow to annular flow in a steam cracking application to enhance the flash drum removal efficiency of non-volatile hydrocarbons.

2. Description of Background and Related Art

Steam cracking has long been used to crack various hydrocarbon feedstocks into olefins. Conventional steam cracking utilizes a furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock is then introduced into the radiant section where the cracking takes place. The resulting olefins leave the furnace for further downstream processing, such as quenching.

Conventional steam cracking systems have been effective for cracking high-quality feedstocks such as gas oil and naphtha. However, steam cracking economics sometimes favor cracking low cost heavy feedstock such as, by way of non-limiting examples, crude oil and atmospheric resid. Crude oil and atmospheric resid contain high molecular weight, non-volatile components with boiling points in excess of 1100° F. (590° C.). The non-volatile, heavy ends of these feedstocks lay down as coke in the convection section of conventional pyrolysis furnaces. Only very low levels of non-volatiles can be tolerated in the convection section downstream of the point where the lighter components have fully vaporized. Additionally, some naphthas are contaminated with crude oil during transport. Conventional pyrolysis furnaces do not have the flexibility to process resids, crudes, or many resid or crude contaminated gas oils or naphthas, which contain a large fraction of heavy non-volatile hydrocarbons.

To solve such coking problem, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 to 1100° F. (230 to 600° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It provides preheating of heavy feed inside or outside a pyrolysis furnace to vaporize about 50% of the heavy feed with superheated steam and the removal of the residual liquid. The vaporized hydrocarbons are subjected to cracking.

U.S. Pat. No. 5,190,634, which is incorporated herein by reference, discloses a process for inhibiting coke formation in a furnace by preheating the feed in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feed is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for super-heating and cracking.

The present inventors have recognized that in using a flash to separate heavy non-volatile hydrocarbons from the lighter volatile hydrocarbons which can be cracked in the pyrolysis furnace, it is important to maximize the non-volatile hydrocarbon removal efficiency. Otherwise, heavy, coke-forming non-volatile hydrocarbons could be entrained in the vapor phase and carried overhead into the furnace creating coking problems.

It has been found that in the convection section of a steam cracking pyrolysis furnace, a minimum gas flow is required in the piping to achieve good heat transfer and to maintain a film temperature low enough to reduce coking. Typically, a minimum gas flow velocity of about 100 ft/sec (30 m/sec) has been found to be desirable.

When using a flash drum to separate the lighter volatile hydrocarbon as vapor phase from the heavy non-volatile hydrocarbon as liquid phase, the flash stream entering the flash drum usually comprises a vapor phase with liquid (the non-volatile hydrocarbon components) entrained as fine droplets. Therefore, the flash stream is two-phase flow. At the flow velocities required to maintain the required boundary layer film temperature in the piping inside the convection section, this two-phase flow is in a "mist flow" regime. In this mist flow regime, fine droplets comprising non-volatile heavy hydrocarbons are entrained in the vapor phase, which is the volatile hydrocarbons and optionally steam. The two-phase mist flow presents operational problems in the flash drum because at these high gas flow velocities the fine droplets comprising non-volatile hydrocarbons do not coalesce and, therefore, cannot be efficiently removed as liquid phase from the flash drum. It was found that, at a gas flow of 100 feet/second (30 m/s) velocity, the flash drum can only remove heavy non-volatile hydrocarbons at a low efficiency of about 73%.

The present invention provides a process for the effective removal of non-volatile hydrocarbon liquid from the volatile hydrocarbon vapor in the flash drum. The present invention provides a process that converts a "mist flow" regime to an "annular flow" regime and hence significantly enhances the separation of non-volatile and volatile hydrocarbons in the flash drum.

Separate applications, one entitled "PROCESS FOR STEAM CRACKING HEAVY HYDROCARBON FEEDSTOCK", U.S. application Ser. No. 10/188,461, Family Number 2002B063US, filed Jul. 3, 2002, and one entitled "PROCESS FOR CRACKING HYDROCARBON FEED WITH WATER SUBSTITUTION", U.S. application Ser. No. 10/188,901, Family Number 2002B091US, filed Jul. 3, 2002, are being concurrently filed herewith and are incorporated herein by reference.

SUMMARY OF THE INVENTION

The present invention provides a process for treating a heavy hydrocarbon feedstock which comprises preheating the heavy hydrocarbon feedstock, optionally comprising steam, in the convection section of a steam cracking furnace to vaporize a portion of the feedstock and form a mist stream comprising liquid droplets comprising non-volatile hydrocarbon in volatile hydrocarbon vapor, optionally with steam, the mist stream upon leaving the convection section having a first flow velocity and a first flow direction, treating the mist stream to coalesce the liquid droplets, the treating comprising first reducing the flow velocity followed by changing the flow direction, separating at least a portion of the liquid droplets from the vapor in a flash drum to form a vapor phase and a liquid phase, and feeding the vapor phase to the thermal cracking furnace.

In one embodiment of the present invention, the vapor phase is fed to a lower convection section and radiant section of the steam cracking furnace.

In one embodiment, the treating of the mist flow comprises reducing the flow velocity of the mist stream. The mist stream flow velocity can be reduced by at least 40%. The mist stream velocity can be reduced to less than 60 feet/second (18 m/s).

According to another embodiment, the mist stream flow velocity is reduced and then is subjected to at least one centrifugal force, such that the liquid droplets coalesce. The mist stream can be subjected to at least one change in its flow direction.

In yet another embodiment in accordance with the present invention, the mist stream droplets are coalesced in a distance of less than 25 pipe diameters, preferably in less than 8 inside pipe diameters, and most preferably in less than 4 inside pipe diameters.

According to another embodiment, the mist stream flows through a flow path that comprises at least one bend. The flow path can further comprise at least one expander. Preferably, the flow path comprises multiple bends. The bends can be at least 45 degrees, 90 degrees, 180 degrees, or combination thereof.

In yet another embodiment, the mist stream is converted into an annular flow stream. The flash efficiency can be increased to at least 85%, preferably at least 95%, more preferably at least 99%, and most preferably at least 99.8%. The mist stream can be converted into an annular flow stream in less than 50 pipe diameters, preferably in less than 25 pipe diameters, more preferably in less than 8 pipe diameters, and most preferably in less than 4 pipe diameters.

Also according to the present invention, a process for treating a hydrocarbon feedstock comprises: preheating a hydrocarbon feedstock, optionally including steam, in the convection section of a thermal cracking furnace to vaporize a portion of the feedstock and form a mist stream comprising liquid droplets comprising hydrocarbon in hydrocarbon vapor, optionally with steam, the mist stream upon leaving the convection section having a first flow velocity and a first flow direction, treating the mist stream to coalesce the liquid droplets, separating at least a portion of the liquid droplets from the vapor in a flash drum to form a vapor phase and a liquid phase, and feeding the vapor phase to the steam cracking furnace, wherein the flash comprises introducing the mist stream containing coalesced liquid droplets into a flash drum, removing the vapor phase from at least one upper flash drum outlet and removing the liquid phase from at least one lower flash drum outlet.

The present invention also discloses another embodiment in which the mist stream is tangentially introduced into the flash drum through at least one tangential drum inlet.

DETAILED DESCRIPTION OF THE INVENTION

Unless otherwise stated, all percentages, parts, ratios, etc., are by weight.

Unless otherwise stated, a reference to a compound or component includes the compound or component by itself, as well as in combination with other compounds or components, such as mixtures of compounds.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

Also as used herein:

Flow regimes are visual or qualitative properties of fluid flow. There is no set velocity and no set drop size. Mist flow refers to a two-phase flow where tiny droplets of liquid are dispersed in the vapor phase flowing through a pipe. In clear pipe, mist flow looks like fast moving small rain droplets.

Annular flow refers to a two-phase flow where liquid flows as streams on the inside surface of a pipe and the vapor flows in the core of the pipe. The vapor flow velocity of annular flow is about 20 feet/second (6 m/s). In clear pipe, a layer of fast moving liquid is observed. Few droplets of liquid are observed in the core of the vapor flow. At the pipe exit, the liquid usually drips out and only a small amount of mist is observed. The change from mist to annular flow usually includes a transition period where mist and annular flow exist together.

The feedstock comprises at least two components: volatile hydrocarbons and non-volatile hydrocarbons. The mist flow, in accordance with the present invention, comprises fine droplets of non-volatile hydrocarbons entrained in volatile hydrocarbon vapor.

The non-volatile removal efficiency is calculated as follows:

$$\text{Non-volatile Removal Efficiency} = \left[1 - \frac{\text{Non-volatiles in the vapor phase leaving flash (mass/time)}}{\text{Non-volatiles in the hydrocarbon entering the flash (mass/time)}}\right] * 100\%$$

Hydrocarbon is the sum of vapor (volatile) and liquid (non-volatile) hydrocarbon. Non-volatiles are measured as follows: The boiling point distribution of the hydrocarbon feed is measured by Gas Chromatograph Distillation (GCD) by ASTM D-6352-98. Non-volatiles are the fraction of the hydrocarbon with a nominal boiling point above 1100° F. (590° C.) as measured by ASTM D-6352-98. More preferably, non-volatiles have a nominal boiling point above 1400° F. (760° C.).

The fraction of non-volatile 1100 to 1400° F. (590 to 760° C.) in the whole hydrocarbon to the furnace and a sample of the flash drum overhead after water is removed are analyzed by ASTM D-6352-98.

Figure 1:
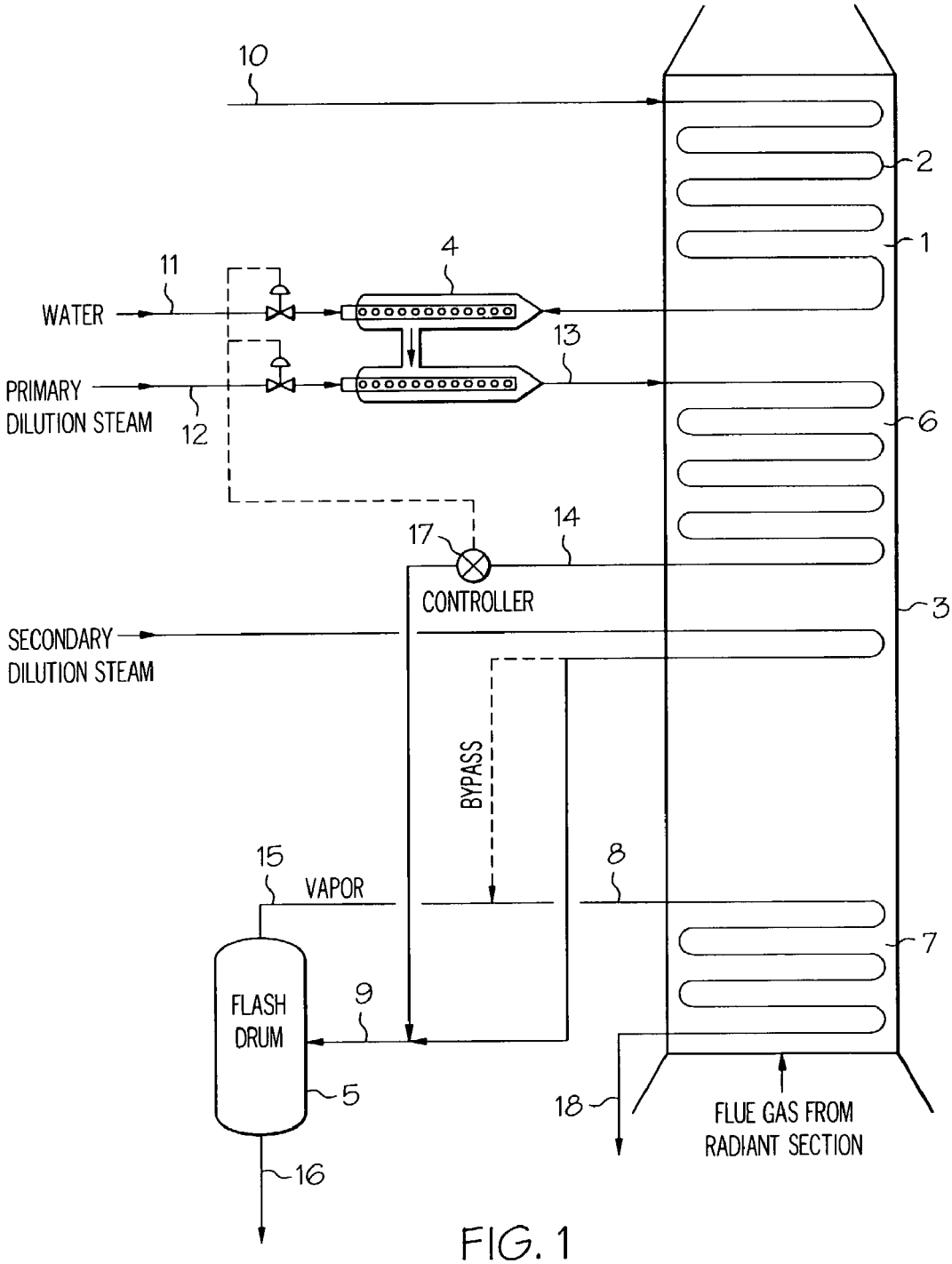
FIG. 1 illustrates a schematic flow diagram of a steam cracking process.

A process for cracking a hydrocarbon feedstock 10 of the present invention as illustrated in FIG. 1 comprises preheating a hydrocarbon feedstock by a bank of exchanger tubes 2, with or without the presence of water 11 and steam 12 in the upper convection section 1 of a steam cracking furnace 3 to vaporize a portion of the feedstock and to form a mist stream 13 comprising liquid droplets comprising non-volatile hydrocarbons in volatile hydrocarbon/steam vapor. The further preheating of the feedstock/water/steam mixture can be carried out through a bank of heat exchange tubes 6. The mist stream upon leaving the convection section at 14 has a first flow velocity and a first flow direction. The process also comprises treating the mist stream to coalesce die liquid droplets, separating at least a portion of the liquid droplets from the hydrocarbon vapor in a flash 5 to form a vapor phase 15 and a liquid phase 16, and feeding the vapor phase at 8 to the lower convection section and the radiant section of the thermal cracking furnace.

As noted, the feedstock is a hydrocarbon. Any hydrocarbon feedstock having heavy non-volatile heavy ends can advantageously be utilized in the process. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric resid, heavy residium, C4's/residue admixture, and naphtha residue admixture.

The heavy hydrocarbon feedstock has a nominal end boiling point of at least 600° F. (310° C.). The preferred feedstocks are low sulfur waxy resids, atmospheric resids, and naphthas contaminated with crude. The most preferred is resid comprising 60–80% components having boiling points below 1100° F. (590° C.), for example, low sulfur waxy resids.

As noted, the heavy hydrocarbon feedstock is preheated in the upper convection section of the furnace 3. The feedstock may optionally be mixed with steam before preheating or after preheating (e.g., after preheating in preheater exchanger tubes 2) in a sparger 4. The preheating of the heavy hydrocarbon can take any form known by those of ordinary skill in the art. It is preferred that the heating comprises indirect contact of the feedstock in the convection section of the furnace with hot flue gases from the radiant section of the furnace. This can be accomplished, by way of non-limiting example, by passing the feedstock through a bank of heat exchanger tubes 2 located within the upper convection section 1 of the pyrolysis furnace 3. The preheated feedstock at 4 before the control system 17 has a temperature between 600 to 950° F. (310 to 510° C.). Preferably the temperature of the heated feedstock is about 700 to 920° F. (370 to 490° C.), more preferably between 750 to 900° F. (400 to 480° C.) and most preferably between 810 and 890° F. (430 to 475° C.).

As a result of preheating, a portion of the feedstock is vaporized and a mist stream is formed comprising liquid droplets comprising non-volatile hydrocarbon in volatile hydrocarbon vapor, with or without steam. At flow velocities of greater than 100 feet/second, the liquid is present as fine droplets comprising non-volatile hydrocarbons entrained in the vapor phase. This two-phase mist flow is extremely difficult to separate into liquid and vapor. It is necessary to coalesce the fine mist into large droplets before entering the flash drum. However, flow velocities of 100 ft/sec or greater are normally necessary to practically effect the transfer of heat from the hot flue gases and reduce coking in convection section.

In accordance with the present invention, the mist stream is treated to coalesce the liquid droplets. In one embodiment in accordance with the present invention, the treating comprises reducing the velocity of the mist stream. It is found that reducing the velocity of the mist stream leaving convection section 6 before the flash 5 (location 9 in FIG. 1) helps coalesce the mist stream. It is preferred to reduce the mist stream velocity by at least 40%, preferably at least 70%, more preferably at least 80%, and most preferably 85%. It is also preferred to reduce the velocity of the mist flow stream leaving the convection section from at least 100 feet/second (30 m/s) to a velocity of less than 60 feet/second (18 m/s), more preferably to less than 30 feet/second (27 to 9 m/s), and most preferably to less than 15 feet/second (27 to 5 m/s).

Annular flow can be achieved by reducing flow velocity due to friction in large diameter pipes. In order to achieve the required reduction to convert mist flow into annular flow, a substantial length of piping is necessary. The required length of piping is defined in terms of the number of inside pipe diameters. Engineering practices require that after reducing the mist flow velocity to 60 feet/second (18 m/s), the friction from 50 to 150 pipe diameters of straight pipe (for instance 24 inches×100=200 feet or 0.6 meters×100=60 meters) is needed to establish annular flow.

Figure 2:
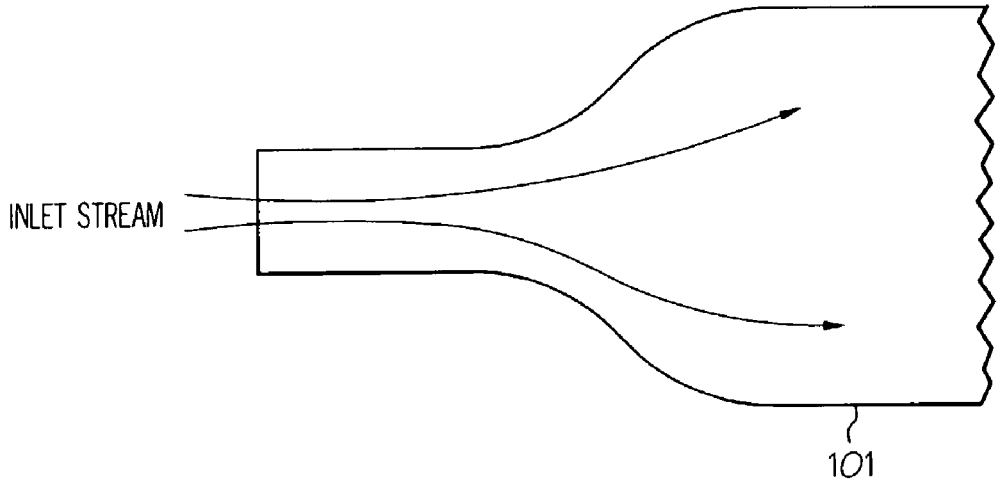
FIG. 2 illustrates the design of expanders.
Figure 2:
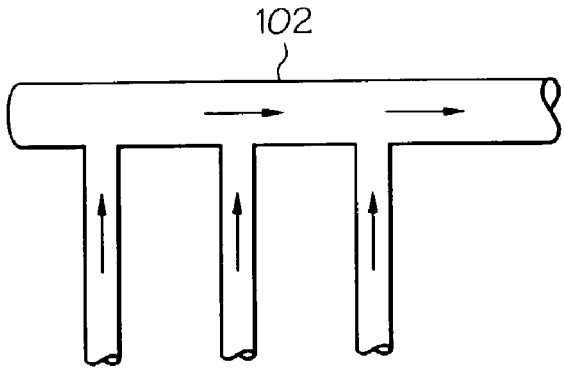

The reduction of velocity of the mist flow stream is accomplished by including in the piping outside the convection section one or more expanders. In a closed system, at least one expander is believed necessary to achieve the preferred reduction of velocity. By way of non-limiting examples, the expander can be a simple cone shape 101 or manifolds 102 as illustrated in FIG. 2. With the cross section area of the outlet end greater than the cross section area of the sum of all the inlets. In a preferred embodiment in accordance with this invention, the mist flow is subject to at least one expander first and then to at least one bend, preferably multiple bends, with various degrees. When the mist flow stream flows through the expander(s), the velocity will decrease. The number of expanders can vary according to the amount of velocity reduction required. As a general practice rule, more expanders can be used if high velocity reduction is required. Any expanders, for example, a manifold, can be used in the present invention.

Although expanders alone will reduce the velocity such that annular flow will be established, it is preferred that at least one bend is used following the reduction in velocity. The bend acts like a centrifuge. The liquid droplets flow to the outer wall of the bend where they can coalesce.

The present invention enables the conversion of mist flow to annular flow in significantly less piping. According to the present invention, the mist stream droplets are coalesced in less than 25, more preferably less than 8, and most preferably less than 4 inside pipe diameters.

In accordance with the present invention, treating of the mist stream comprises subjecting the mist stream to at least one expander and one centrifugal force downstream of the expander such that the liquid droplets will coalesce. This can be accomplished by subjecting the mist stream to at least one change in its flow direction. The piping outside the convection section is designed to include at least one bend in order to convert a mist flow stream into an annular flow stream. The bends can be located throughout the piping downstream of the expander between the control system 17 and just before the flash drum.

Different angle bends can be used. For example, 45 degree, 90 degree, and/or 180 degree bends can be used in the present invention. After an expander, the 180 degree bend provides the most vapor core velocity reduction. In one embodiment of the present invention, the process includes at least one bend of at least 45 degrees. In another embodiment, the process includes at least one bend of 90 degrees. In yet another embodiment, the process includes at least one bend of 180 degrees.

It is found that using the inventions disclosed herein, a flash drum removal efficiency of at least 85% can be accomplished. A preferred flash efficiency of at least 95%, a more preferred flash efficiency of at least 99%, and a most preferred flash efficiency of at least 99.8% can also be achieved using the present invention.

After the required reduction of velocity, e.g., in a combination of expanders, the fine droplets in the mist flow stream will coalesce in one or more bends and thus are easily separated from the vapor phase stream in the flash drum 5. Flash is normally carried out in at least one flash drum. In the flash drum 5, the vapor phase stream is removed from at least one upper flash drum outlet and the liquid phase is removed from at least one lower flash drum outlet. Preferably, two or more lower flash drum outlets are present in the flash for liquid phase removal.

Also according to the present invention, a process for treating a hydrocarbon feedstock comprises: heating a liquid hydrocarbon feedstock in the convection section of a thermal cracking furnace to vaporize a portion of the feedstock and form a mist stream comprising liquid droplets comprising hydrocarbon in hydrocarbon vapor, with or without steam, the mist stream upon leaving the convection section having a first flow velocity and a first flow direction, treating the mist stream to coalesce the liquid droplets, separating at least a portion of the liquid droplets from the hydrocarbon vapor in a flash drum to form a vapor phase and a liquid phase, and feeding the vapor phase to the radiant section of the steam cracking furnace, wherein the flash comprises introducing the stream containing coalesced liquid droplets into a flash drum, removing the vapor phase from at least one upper flash drum outlet and removing the liquid phase from at least one lower flash drum outlet.

Figure 3:
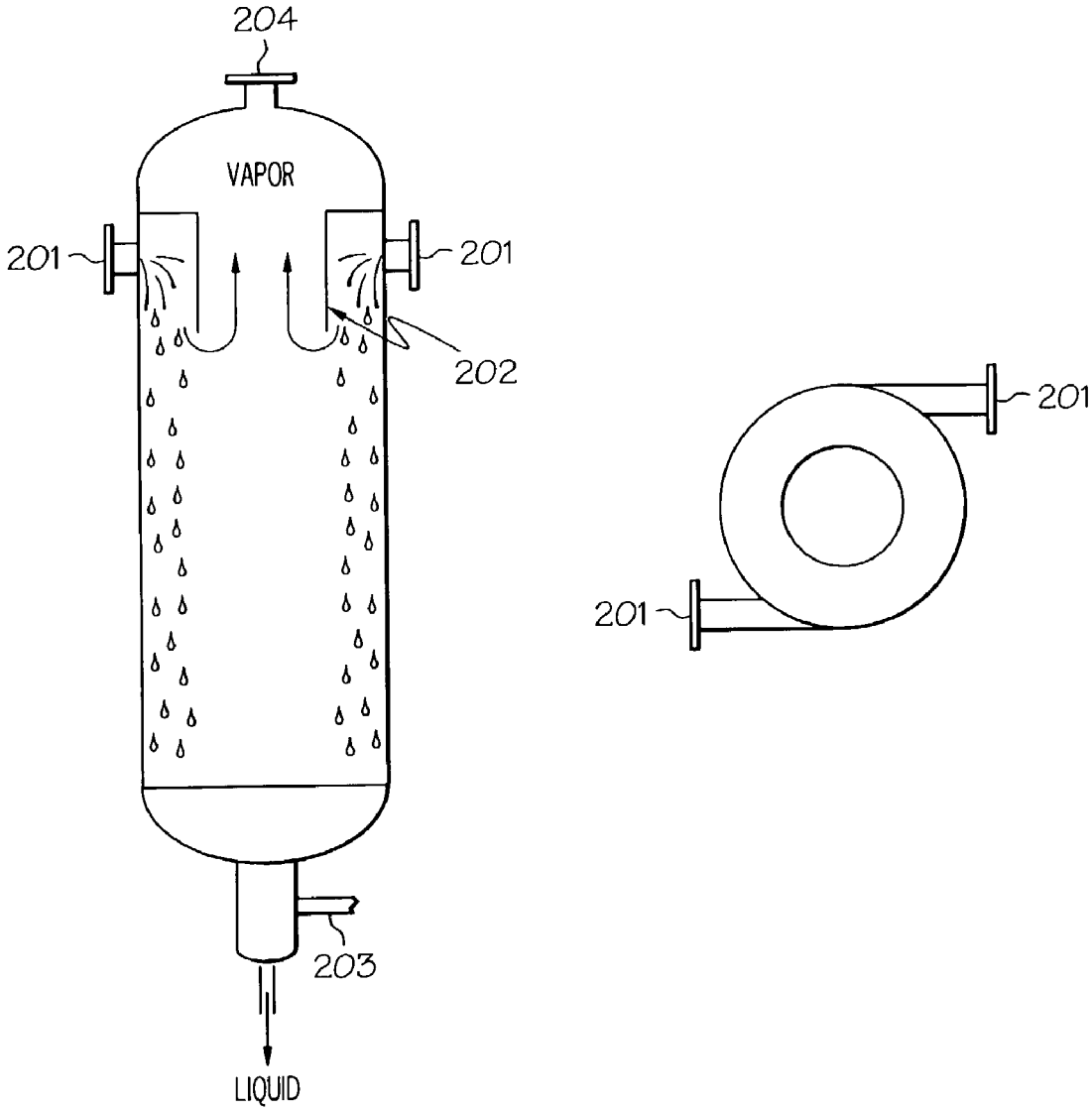
FIG. 3 illustrates the design of a flash drum in accordance with the present invention.

A flash drum in accordance to the present invention is illustrated in FIG. 3. The removal efficiency of the flash drum decreases as liquid droplet size entering the flash drum decreases. The droplet size decreases with increasing gas velocity. To increase separation efficiency, a sufficient length of pipe, expanders, and bends are required to establish a stable droplet larger size at a lower velocity.

To further increase the removal efficiency of the non-volatile hydrocarbons in the flash drum, it is preferred that the flash stream 9 of FIG. 1 enters the flash drum tangentially through at least one tangential flash drum inlet 201 of FIG. 3. Preferably, the tangential inlets are level or slightly downward flow. The non-volatile hydrocarbon liquid phase will form an outer annular flow along the inside flash drum wall and the volatile vapor phase will initially form an inner core and then flow upwardly in the flash drum. In one preferred embodiment, the tangential entries should be the same direction as the Coriolis effect.

The liquid phase is removed from one bottom flash drum outlet. Optionally, a side flash drum outlet (203) or a vortex breaker can be added to prevent a vortex forming in the outlet. The upward inner core flow of vapor phase is diverted around an annular baffle 202 inside the flash drum and removed from at least one upper flash drum outlet 204. The baffle is installed inside the flash drum to further avoid and reduce any portion of the separated liquid phase, flowing downwards in the flash drum, from being entrained rn the upflow vapor phase in the flash drum. The vapor phase, preferably, flows to the lower convection section 7 of FIG. 1 and through crossover pipes 18 to the radiant section of the pyrolysis furnace.

The invention is illustrated by the following Example, which are provided for the purpose of representation, and are not to be construed as limiting the scope of the invention. Unless stated otherwise, all percentages, parts, etc., are by weight.

EXAMPLE 1

The vapor/liquid separation efficiency of a flash drum separation is highly dependent on droplet size. Stoke's law teaches that the terminal velocity of a drop or a particle is proportional to its diameter squared. Hence, if a very fine mist enters a flash drum, the upward gas velocity will be greater than the terminal velocity of the droplets causing entrainment. Extensive coalescing of droplets into annular flow produces very large droplets which separate easily in a flash drum.

Annular flow can be effected by reducing the bulk flow velocity and allowing sufficient time and friction for coalescing of droplets. After the bulk velocity is reduced, roughly 100 pipe flow diameters are required to coalesce drops. Air/water flow tests were conducted to determine how to produce annular flow in less than 100 pipe diameters. Two 6 HP blowers produced a high velocity gas in 2" ID pipe. The air from the two blowers combine in a Y-fitting and flow into the 2" ID clear pipe. Just before the clear pipe is a T-fitting where water is added to produce the mist flow. An anemometer at the end of the piping system measures the fluid velocity.

Various piping bends, for example 45 degrees, elbows, and return bends, and expanders were tested to observe whether the fine droplet in the mist flow stream coalesced. They are summarized below in Table 1.

TABLE 1

Observation of Droplet Coalescing

| Test | Description | Observation |
|---|---|---|
| 1 | Added 6 GPM of water to the air producing two phase flow at 110 ft/sec bulk velocity | Fine droplet mist flow in 2" ID pipe |
| 2 | Added a 90° bend to provide a centrifugal force | Mist flow is intensified |
| 3 | To the end of the straight 2" ID pipe added an expander and 6 ft of 3" clear pipe | Mist flow throughout the 6 ft or 25 IDs of 3" clear pipe |
| 4 | Added 12 ft more of 3" clear pipe to test 3 for a total of 18 ft or 75 diameters | Some droplet coalescing but mist still exists |
| 5 | To the end of the straight 2" ID pipe added an expander to 3" ID, a 90° elbow and 6 ft. of 3" clear pipe - velocity 50 ft/sec | Significant coalescing of droplet drops annular flow with some mist. |
| 6 | To the end of the 2" ID pipe added an expander to 6" ID, 90° elbow, 4 ft of 6" ID pipe, 90° elbow and 4 ft of 6" ID pipe | Annular and stratified flow with less than a trace of mist |

The conclusions of the observations are as follows: Test 2 showed that a bend alone at high velocity does not coalesce droplets and may even produce a finer mist. Tests 3 and 4 showed that an expander alone did not coalesce droplets enough even after 75 pipe diameters of the larger diameter pipe. Tests 5 and 6 showed that expanders followed by bends with short lengths of straight pipe did coalesce droplets. The larger the expanders followed by bends, the more complete the droplet coalescing into annular and even stratified flow.

Although the present invention has been described in considerable detail with reference to certain preferred embodiments, other embodiments are possible, and will become apparent to one skilled in the art. Therefore, the spirit, scope of the appended claims should not be limited to the descriptions of the preferred embodiments contained herein.

What is claimed is:

1. A process for treating a heavy hydrocarbon feedstock comprising: preheating the heavy hydrocarbon feedstock, optionally comprising steam, in the convection section of a steam cracking furnace to vaporize a portion of the feedstock and form a mist stream comprising liquid droplets comprising non-volatile hydrocarbon in volatile hydrocarbon vapor, optionally with steam, the mist stream upon leaving the convection section having a flow velocity and a flow direction; treating the mist stream to coalesce the liquid droplets, the treating comprising first reducing the flow velocity followed by changing the flow direction; separating at least a portion of the liquid phase from the vapor phase in a flash drum; and feeding the vapor phase to the steam cracking furnace.

2. The process of claim 1 further comprising feeding the vapor phase to a lower convection section and radiant section of the steam cracking furnace.

3. The process of claim 1 wherein the heavy hydrocarbon feedstock comprises one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric resid, heavy residium, $C_4$'s/residue admixture, and naphtha/residue admixture.

4. The process according to claim 1 wherein the heavy hydrocarbon feedstock comprises low sulfur waxy resid.

5. The process according to claim 1 wherein 60 to 80 percent of the heavy hydrocarbon feedstock boils below 1100° F.

6. The process of claim 2 wherein the flow velocity of die mist stream is reduced by at least 40%.

7. The process of claim 3 wherein the flow velocity of the mist stream is reduced by at least 40%.

8. The process of claim 2 wherein the flow velocity of the mist stream is reduced to less than 60 feet/second (18 m/s).

9. The process of claim 3 wherein the flow velocity of the mist stream is reduced to less than 60 feet/second (18 m/s).

10. The process of claim 2 wherein the treating comprises first reducing the flow velocity of the mist stream to less than 60 ft/sec (18 m/s) and then subjecting the mist stream to at least one centrifugal force such that the liquid droplets coalesce.

11. The process of claim 3 wherein the treating comprises first reducing the flow velocity of die mist stream to less than 60 ft/sec (18 m/s) and then subjecting the mist stream to at least one centrifugal force such that the liquid droplets coalesce.

12. The process of claim 2 wherein droplets in the mist stream are substantially coalesced in a distance of less than 25 inside pipe diameters.

13. The process of claim 2 wherein droplets in the mist stream are substantially coalesced in a distance of less than 4 inside pipe diameters.

14. The process of claim 8 wherein the mist stream flows through a flow path that comprises first at least one expander and at least one bend.

15. The process of claim 2 wherein treating converts the mist into an annular flow stream.

16. The process of claim 3 wherein the process achieves a non-volatile separation efficiency of at least 85%.

17. The process of claim 3 wherein the process achieves a non-volatile separation efficiency of at least 95%.

18. The process of claim 3 wherein the process achieves a non-volatile separation efficiency of at least 99%.

19. The process of claim 3 wherein the process achieves a non-volatile separation efficiency of at least 99.8%.

20. The process of claim 3 wherein the mist stream is in the mist flow regime and convened into an annular flow regime in a distance of less than 25 pipe diameters.

21. The process of claim 14 wherein the mist stream is in the mist flow regime and convened into an annular flow regime in a distance of less than 4 pipe diameters.

22. The process of claim 14 wherein the mist stream flows through a flow path that comprises multiple bends.

23. The process of claim 22 wherein at least one bend is at least 45 degrees.

24. The process of claim 22 wherein at least one bend is at least 90 degrees.

25. The process of claim 22 wherein at least one bend is 180 degrees.

* * * * *